US005730587A

United States Patent [19]

Snyder et al.

[11] Patent Number: 5,730,587

[45] Date of Patent: Mar. 24, 1998

[54] BAND DRIVE DUAL DIAPHRAGM PUMP

[75] Inventors: Larry R. Snyder, Victorville; Ivar Schoenmeyer, San Juan Capistrano, both of Calif.

[73] Assignee: Apollo Enterprises, Inc., Ontario, Calif.

[21] Appl. No.: 682,363

[22] Filed: Jul. 17, 1996

[51] Int. Cl.[6] ..... F04B 43/04

[52] U.S. Cl. ..... 417/413.1

[58] Field of Search ..... 417/412, 413.1

[56] References Cited

U.S. PATENT DOCUMENTS

| | | | |
|---|---|---|---|
| 3,545,894 | 12/1970 | Lovitz | 417/412 |
| 3,671,151 | 6/1972 | Duke et al. | 417/413.1 X |
| 3,825,374 | 7/1974 | Kondo | 417/413.1 |
| 4,565,497 | 1/1986 | Miller et al. | 417/412 X |
| 4,610,608 | 9/1986 | Grant | 417/413.1 |

*Primary Examiner*—Richard E. Gluck
*Attorney, Agent, or Firm*—James E. Brunton

[57] ABSTRACT

An improved dual air pump in which the diaphragm elements of the pump that cover the pump chamber are connected to an elastic band which is shaped as an inverted U, having magnet mounting surfaces provided proximate the extremities of the downwardly depending sides of the band. Support of this vibrating structure is obtained solely from the diaphragms themselves which are attached proximate the center of the sides of the elastic band. The magnetic mounting surfaces of the elastic band are superimposed over a conventional electromagnetic drive unit which, when energized with an alternating voltage, will alternately attract and repel the permanent magnets mounted on the magnet mounting surfaces so as to alternately extend and compress the flexible diaphragm elements to create a pumping action.

14 Claims, 3 Drawing Sheets

BAND DRIVE DUAL DIAPHRAGM PUMP

BACKGROUND OF THE INVENTION

1. Field of the Invention

The present invention relates generally to methods and apparatus for pumping and dispensing of fluids. More particularly, the invention concerns improvements in electromagnetic air pumps for use in the aeration of water contained within an aquarium.

2. Background of the Art

Fluid pumps are generally well known and typically comprise a driven pump element for drawing a fluid such as air into an internal pumping chamber through inlet valve means and then expelling the fluid under pressure from the pumping chamber through outlet valve means associated with a pump outlet port. Such pumps are provided in a wide variety of configurations, including those known as diaphragm pumps in which flexible diaphragm members define a portion of at least one wall in a pumping chamber. The diaphragm portion of the pump can be reciprocated by a direct mechanical drive, or alternatively, by electromagnetic motive means which in turn may act remotely or directly on permanent magnets carried on the diaphragm.

Dual pumping devices are also well known in the art. These devices may be combined in order to increase pump flow capacity at a given pressure, or may be used to furnish air to parallel outlet lines of equal or different resistivity.

Exemplary of early dual pumps are those described in U.S. Pat. No. 3,671,151 to Duke et al. In these devices, the vibrating elements are generally L-shaped, with a horizontal portion at the lower end to support permanent magnets. The upper ends are hangingly mounted to a pivot attached to the top of the motor frame. In this design the L-shaped elements move together, but the magnet ends can separate more than the fixed upper ends, thereby allowing the elements to become non-parallel. In U.S. Pat. No. 4,154,559 issued to Enomoto, the two vibrators therein described are mechanically connected. A horizontal strap connects the two vibrators at a point above the magnets and below the diaphragm attachment points. This strap functions to make the vibrators rotate as a parallelogram, with somewhat more uniform motion. The fact that these designs rotate about fixed top supports, however, means that the magnets receive a vertical lift component which changes the air gaps above the core poles. As the permanent magnets move laterally, the increased air gap of one results in a non-linear reduction of attraction, while the reduced air gap of the other increases the repulsive force.

The prior art also teaches that if a pivot is employed using an elastomer dampener to quiet the pump, this piece will typically wear gradually and result in degraded performance.

SUMMARY OF THE INVENTION

The present invention is directed to a novel dual air pump in which the diaphragm elements of the pump are connected to an elastic band which is shaped as an inverted U, having magnet mounting surfaces provided proximate the extremities of the downwardly depending sides of the band. The width of the structure is made much larger than the thickness, therefore becoming a spring-like band and adding lateral stability. Support of this unique vibrating structure is obtained solely from the diaphragms themselves which are attached proximate the center of the sides of the elastic band.

The magnetic mounting surfaces of the elastic band are superimposed over a conventional electromagnetic drive unit which, when energized with an alternating voltage, will alternately attract and repel the permanent magnets mounted on the magnet mounting surfaces. More particularly, with the novel construction of the pump apparatus of the present invention, each side of the spring-like band structure can be made to resonate as a function of the thickness of the sides of the band. As the flexure stiffness decreases, the side characteristics become similar to those of a single leaf spring. With reducing stiffness, or by the addition of increased mass at permanent magnet ends of the sides, the natural frequency of a flexible side will reduce. With the proper selection of material thickness, length below the diaphragm attachment points, and mass at the permanent magnet end, the resonant bending frequencies can be matched or "tuned" near the electrical driving frequency of at submultiples thereof. When this is done, the magnet ends lock in synchronism and improved stability results. It may also be noted that the average driving power at the resonant frequency can be reduced by the use of a pulsed rather than a sinusoidal drive source.

With the foregoing in mind, it is an object of the present invention to provide an improved dual diaphragm pumping system wherein the diaphragms are mutually coupled by a common, uniquely configured elastic, resiliently deformable band.

It is another object of the invention to provide an improved dual diaphragm pump of the aforementioned character which operates at reduced electrical power as compared with conventional units of similar pumping capacity.

Yet another object of this invention is to provide an open diaphragm drive unit which does not require a top over.

An additional objective of this invention is to provide a fluid pump of the character described in which the pivot points found in the prior art structures have been eliminated thereby eliminating undesirable wear points.

Still other objects of the invention are to provide an improved dual diaphragm pumping unit which can be inexpensively manufactured, is structurally rigid and safe, is highly reliable in operation, and can be easily retrofitted in place of existing pumps.

It is also an objective of the invention to provide a diaphragm pump subassembly that can be easily separated from the electromagnetic subassembly to permit the use of different combinations of pump subassemblies and electromagnet subassemblies for different end uses of the apparatus requiring different performance characteristics.

The above and other objects, features and advantages of the present invention will become more apparent from the following description when making reference to the detailed description and to the accompanying sheets of drawings in which preferred structural embodiments incorporating the principals of this invention are shown.

DISCUSSION OF THE INVENTION

Figure 1:
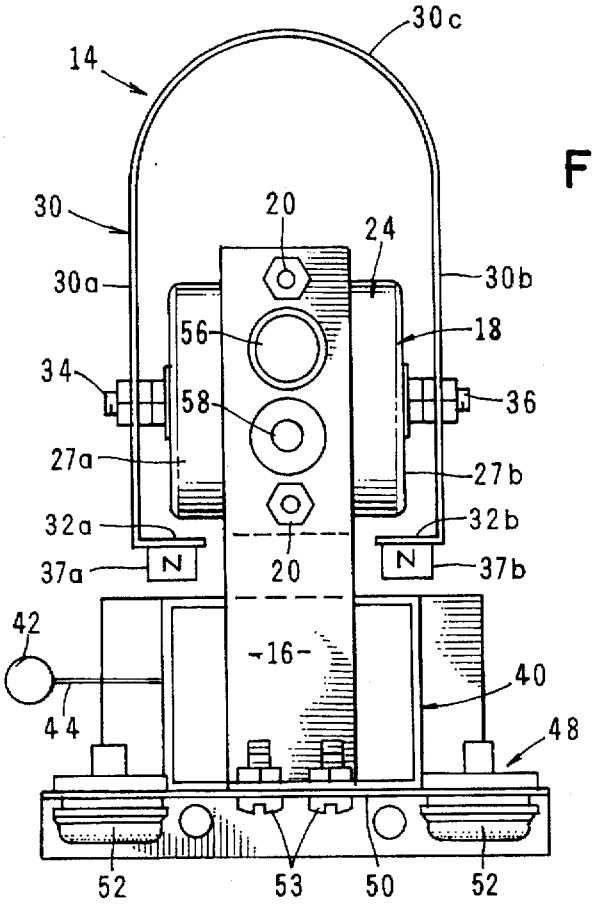
FIG. 1 is a front view of one form of the band-drive, dual-diaphragm pump of the invention.
Figure 2:
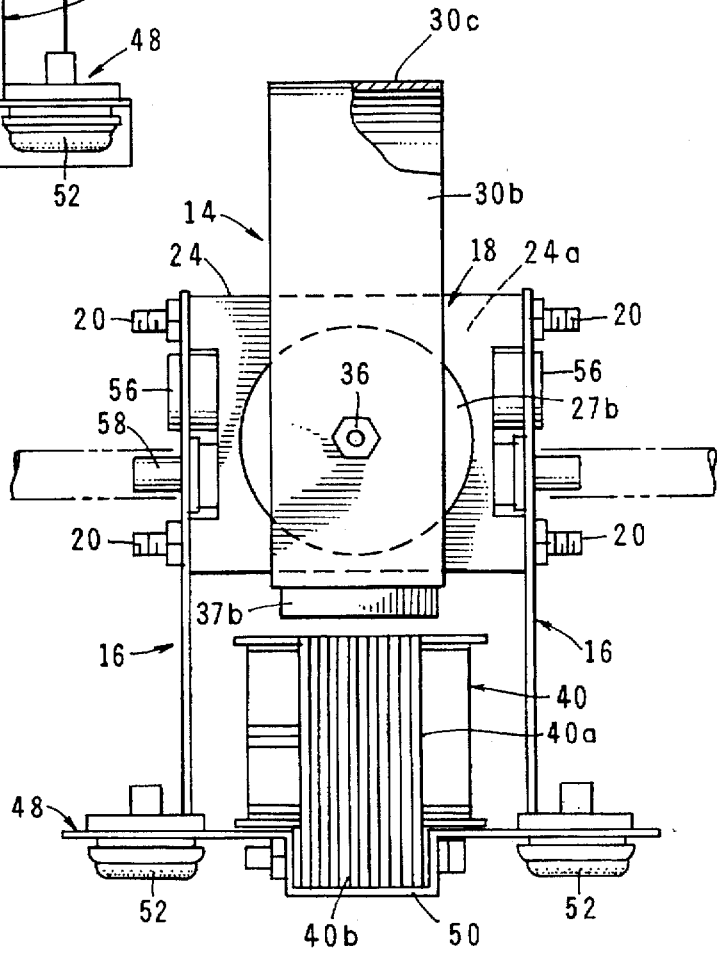
FIG. 2 is a side-elevational view of the pump shown in FIG. 1.
Figure 3:
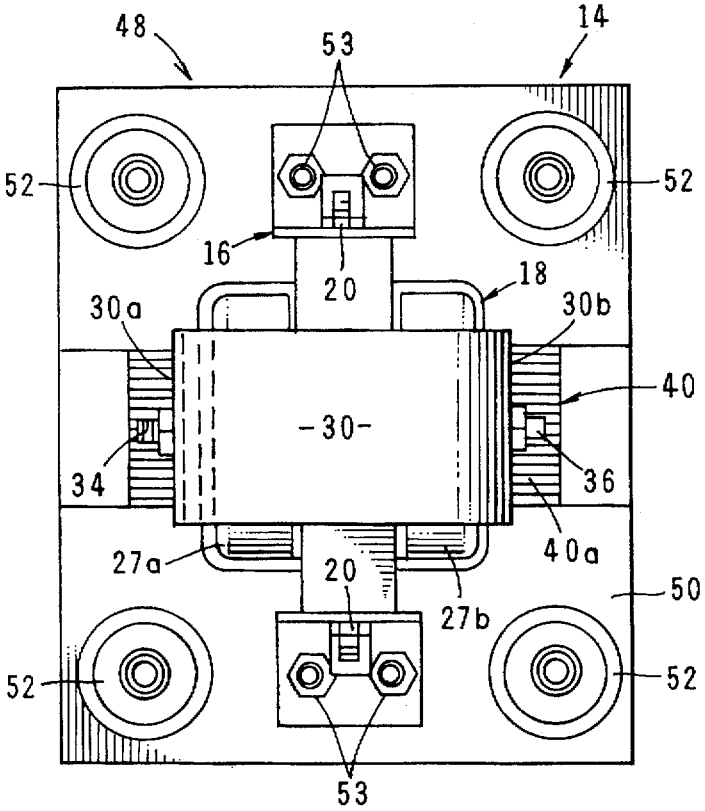
FIG. 3 is an enlarged top plan view of the pump shown in FIG. 1.

Referring to the drawings and particularly to FIGS. 1, 2, and 3, one form of the band-drive, dual-diaphragm, electromagnetic, reciprocating fluid pump is there shown and generally identified by the numeral 14. This embodiment of the invention comprises a supporting frame 16 to which a pump assembly 18 is connected by a plurality of threaded connectors 20. Pump assembly 18 here comprises a pump body 24 having a pumping chamber 24*a* (FIG. 2) and a pair of reciprocally movable, and yieldably deformable flexible diaphragms 27*a* and 27*b* which are connected on the opposite sides of the pump body 24 for communication with pump chamber 24.

Figure 4:
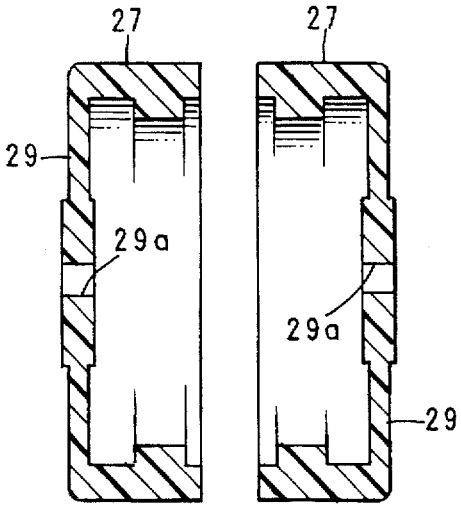
FIG. 4 is a cross-sectional view of one form of diaphragm of the band-drive, dual-diaphragm pump of the invention.
Figure 5:
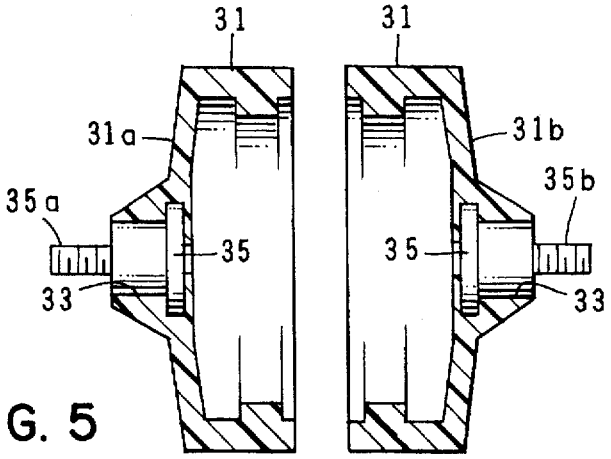
FIG. 5 is a cross-sectional view of an alternate form of the diaphragm of the invention.

Forming a very important aspect of the apparatus of the present invention is a generally U-shaped elastic band member 30 having first and second sides 30*a* and 30*b* respectively which are interconnected by a bight portion 30*c*. Sides 30*a* and 30*b* terminate in end portions 32*a* and 32*b* respectively (FIG. 1). As indicated in FIG. 1, diaphragm 27*a* is connected to side 30*a* of band 30 by means of a threaded connector 34. Similarly, diaphragm 27*b* is connected to side 30*b* of elastic band 30 by means of a threaded connector 36. Diaphragms 27*a* and 27*b* are of identical construction and are of a character well known in the art. By way of example, readily commercially available diaphragms 27 are shown in cross section in FIG. 4. Each diaphragm 27 includes a resiliently deformable end wall 29 having a central aperture 29*a* adapted to receive the threaded connectors which connect the diaphragms to band 30. An alternate form of diaphragm is illustrated in cross section in FIG. 5. These diaphragms, which are generally designated by the numeral 31, include resiliently deformable concave end walls 31*a* and 31*b* each having a central aperture 33 for receiving a plug 35 which includes an integrally formed threaded connectors 35*a* and 35*b* for use in connecting the diaphragms to band 30. (See also FIGS. 6 and 7).

Connected to end portion 32*a* of band 30 is a first permanent magnet 37*a* of conventional construction. Similarly, a second permanent magnet 37*b* is connected to end portion 32*b* of band 30. Disposed beneath first and second permanent magnets 37*a* and 37*b* is electromagnet means, here shown as an electromagnet 40 of conventional construction, which is interconnected with a source of alternating current 42 by means of a connector 44 (FIG. 1). Electromagnet 40 includes an "E" core 40*a* and a winding 40*b* surrounding the core.

Both frame 16 and electromagnet 40 are supported by a base assembly 48 which includes a generally rectangular shaped base plate 50. As indicated in FIG. 2, electromagnet 40 is mounted on base 50 which, in turn, is vibration isolated from frame 16 and pump assembly 18 by means of isolation means, here shown as four shock absorber assemblies 52 which are interconnected with base 50 by connectors 53 in the manner best seen in FIGS. 2 and 3.

In operating of the apparatus of the invention shown in the drawings, when electromagnet 40 is interconnected with source 42 and is energized with an alternating voltage, it will alternately attract and repel the permanent magnets mounted on end portions 32*a* and 32*b* of elastic band 30. For example, during a 60 hertz period, when one of the permanent magnets is attracted toward or repelled from the electromagnet, the second permanent magnet will similarly be attracted toward or repelled from the electromagnet. It is apparent that the first permanent magnet will move one of the sides of the elastic band member 30 so as to extend or compress the resiliently deformable end walls of the diaphragm attached thereto. At the same time, the second magnet will also move the other side of band member 30 to similarly extend or compress the resiliently deformable end walls of the diaphragm attached to this second side of the elastic band.

As previously mentioned, each side of the spring band structure can be made to flex as a function of the thickness of the sides of the band. As the flexure stiffness decreases, the side characteristics become similar to those of a single leaf spring. With reducing stiffness, or by the addition of increased mass at the permanent magnet ends of the sides of the band, the natural frequency of a flexible side wall will reduce. With the proper selection of material thicknesses, the resonant bending frequencies can be matched or "tuned" near the electrical driving frequency or at seven multiples thereof. When this is done, the magnet ends lock in synchronizism and improved stability results. As previously mentioned, it should also be understood that the average driving power at the resonant frequency can be reduced by use of a pulsed rather than a sinusoidal drive source.

From empirical tests, it can be shown that 60 hertz resonance can be accomplished using an elastic band constructed from stainless steel having a width of approximately one inch and a thickness of approximately 0.020 inches and an effective length of about 3 inches. Preferably the diaphragms are mounted approximately one inch from the respective ends of the elastic band. An example of a magnet size which is practical for use with the pump of the invention is a magnet having dimensions of about 1.2 inches by 0.35 inches by 0.25 inches.

As best seen by referring to FIGS. 1 and 2, each pump unit has inlet and outlet ports 56 and 58 respectively within which appropriate inlet and outlet valve means are mounted. By way of example, conventional types of "duck-bill" check valves of a character well known to those skilled in the art can function satisfactorily as the valve means of the invention. In operation, as the diaphragms alternately extend and compress, fluid, such as air, will be drawn into the internal pumping chamber via the inlet valve means and then will be expelled from the internal pumping chamber via the outlet valve means. More particularly, with the construction shown in the drawings, as the north pole of permanent 37*a* is attracted by the south pole of the core of electromagnet 40, the magnet will act on side 30*a* of elastic band 30 causing compression of the end wall of diaphragm 27*a*. When the polarity of electromagnet reverses, an opposite action will result causing an outward movement of side 30*a* of the elastic band and an extension of end wall of the diaphragm 27*a*. As the diaphragm wall alternately extends and compresses, a pumping action will, of course, occur and air will alternately be drawn into and expelled from the pump chamber 24 via the inlet and outlet ports 56 and 58 respectively. A similar action, of course, occurs with respect to diaphragm 27*b* and, as permanent magnet 37*b* is alternately attracted and repulsed by the core of electromagnet 40, the end wall of diaphragm 27*b* will alternately compress and extend due to the urging of side 30*b* of elastic band 30 causing a pumping action to occur within the second pumping unit of the invention of which diaphragm 27*b* forms a part.

It is at once apparent that the major difference between the apparatus of the present invention and that of the prior art resides in the fact that the vibrator arms to which the diaphragms are interconnected are no longer independently suspended, but rather are mutually coupled by the free standing elastic band 30. Accordingly, band 30 assists in maintaining a given drive mechanical phase relationship between the drive motions of each diaphragm pump. In addition, the freedom from frame coupling typically found in the prior art devices permits the arms to laterally translate and maintain a more constant air gap beneath the permanent magnets. It should also be noted that the center top portion of the elastic band remains essentially motionless while each side acts as a cantilever spring with a magnetic mass affixed to each end thereof. This highly novel, efficient and unique construction is nowhere suggest by or disclosed in the prior art.

Figure 7:
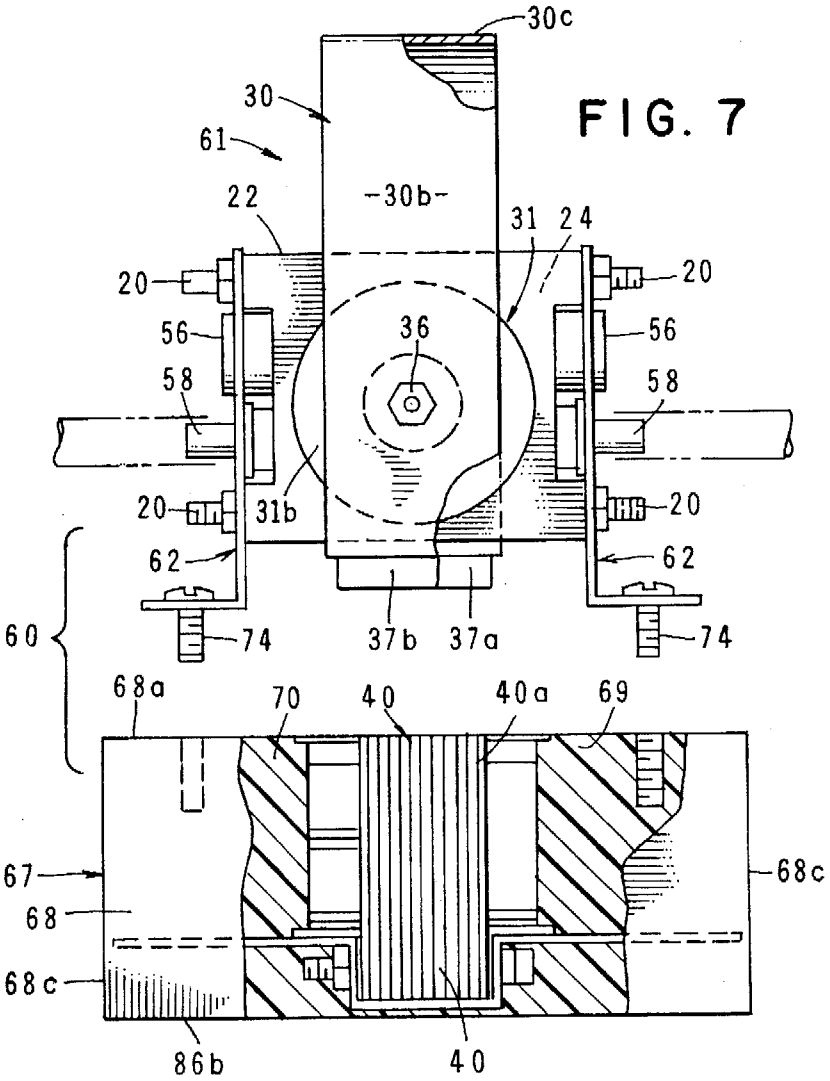
FIG. 7 is an exploded, side-elevational view of the pump shown in FIG. 6.
Figure 6:
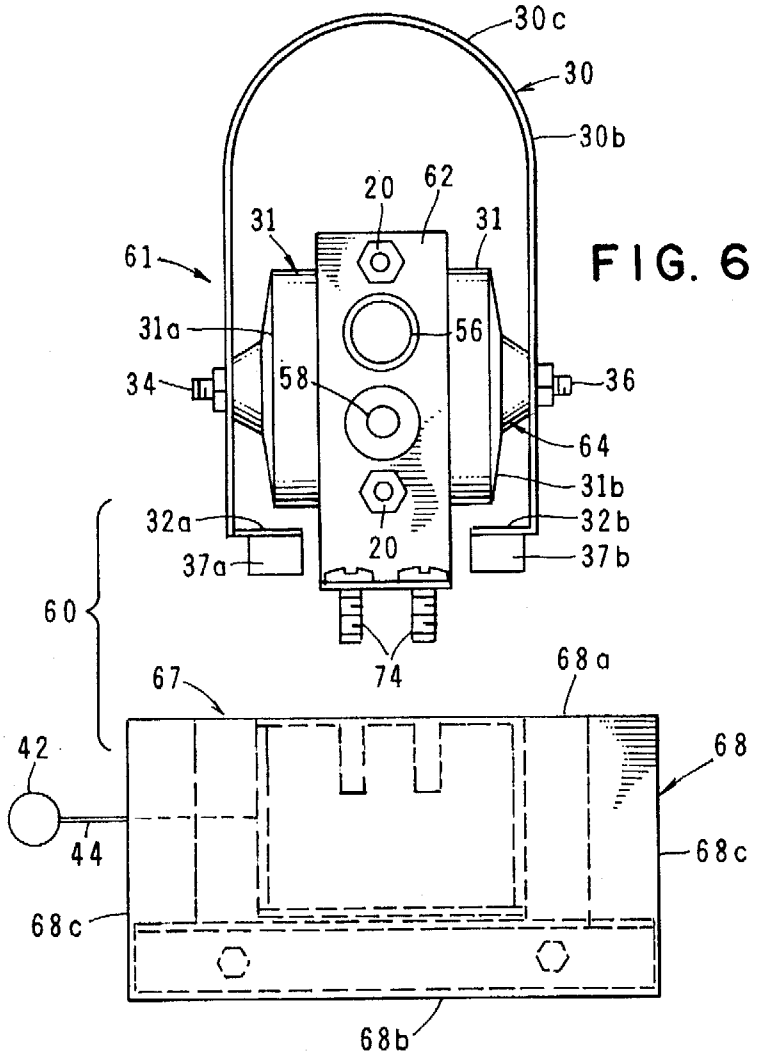
FIG. 6 is an exploded front view of an alternate form of the band-drive, dual-diaphragm pump of the invention.

Turning to FIGS. 6 and 7, an alternate form of the band-drive, dual-diaphragm, electromagnetic, reciprocating fluid pump of the invention is there shown and generally identified by the numeral 60. This embodiment of the invention is similar in many respects to that shown in FIGS. 1 through 5 and like numerals have been used to identify like components. The primary difference between this second embodiment of the invention and that earlier described resides in the fact that the apparatus here comprises removably interconnected pump and electromagnetic subassemblies, with the electromagnet of the latter subassembly being maintained at all times in a waterproof environment. With this novel arrangement, the apparatus can be specially tailored to meet specific end use requirements by interchanging pump subassemblies and electromagnetic subassemblies to meet specific needs.

In this alternate form of the invention, the pump subassembly 61 comprises a supporting frame 62 to which a pump unit 64 is connected by a plurality of threaded connectors 20. Pump unit 64 includes a pump body identical to that previously described having a pumping chamber 24 (FIG. 7). Pump unit 64 also includes a pair of reciprocally movable and yieldably deformable flexible diaphragms having walls 31*a* and 31*b* of the character previously described and illustrated in FIG. 5. As shown in FIG. 6, these diaphragms are connected on the opposite sides of the pump body 22 for communication with pump chamber 24. As before the pump unit comprises a generally U-shaped elastic band member 30 having first and second sides 30*a* and 30*b* respectively which are interconnected by a bight portion 30*c*. Sides 30*a* and 30*b* terminate in end portions 32*a* and 32*b* respectively (FIG. 6). As indicated in FIG. 6, diaphragm 31*a* is connected to side 30*a* of band 30 by means of a threaded connector 34. Similarly, diaphragm 31*b* is connected to side 30*b* of elastic band 30 by means of a threaded connector 36. Similarly, diaphragm 31*b* is connected to side 30*b* of elastic band 30 by means of a threaded connector 36. Diaphragms 31*a* and 31*b* are of the construction previously described and operate in substantially the same manner as diaphragms 27*a* and 27*b*. When the first and second permanent magnets 37*a* and 37*b*, which are carried by the end portions 32*a* and 32*b* of band member 30 interact with the electromagnetic means of the electromagnet subassembly.

In the alternate form of the invention, the electromagnetic subassembly 67, to which pump subassembly 61 is removably connected comprises a housing 68 which is made up of interconnected top, bottom and side walls 68*a*, 68*b*, and 68*c* respectively. For certain applications these walls, which cooperate to define an interior space 69, can be sealably interconnected to render the housing watertight. Disposed within interior space 69 of housing 68 is the electromagnetic means of the invention which, as before, is provided in the form of electromagnet 40 which includes a center core 40*a* and a winding 40*b* surrounding the center core. electromagnet 40 is suitably interconnected with a source of electricity 42 and is energized in a manner well known to those skilled in the art. In the alternate form of the invention shown in FIGS. 6 and 7, the electromagnet 40, including its core 40*a* and winding 40*b*, is encapsulated within a suitable potting compound 70 (FIG. 7) of a character well known in the art to maintain the electromagnet in a waterproof environment.

With supporting frame 62 connected to top wall 68*a* of housing 68 and to the potting compound 70 by suitable connectors 74, the apparatus can be operated in the manner previously described. More particularly, when the electromagnet 40 is interconnected with electrical source 42 and is energized, it will alternately attract and repel the permanent magnets mounted on end portions 32*a* and 32*b* of elastic band 30. As before, to accomplish the pumping action, the first permanent magnet will move one of the side of the elastic band member 30 so as to extend or compress the diaphragm attached thereto and at the same time, the second magnet will move the other side of band member 30 so as to also expand or compress the diaphragm attached to this second side of the elastic band.

Having now described the invention in detail in accordance with the requirements of the patent statutes, those skilled in this art will have no difficulty in making changes and modifications in the individual parts of their relative assembly in order to meet specific requirements or conditions. Such changes and modification may be made without departing from the scope and spirit of the invention, as set forth in the following claims.

We claim:

1. A fluid pumping apparatus comprising:

(a) a supporting frame;

(b) a pump assembly connected to said supporting frame, said pump assembly comprising:

(i) a pump body having a pumping chamber having an inlet and an outlet; and (ii) a first yieldable diaphragm connected to said pump body;

(c) an elastic band comprising a generally U-shaped member having first and second sides interconnected by a curved bight portion, each of said sides terminating in an end portion, said first yieldable diaphragm being connected to said first side of said elastic band;

(d) a first permanent magnet connected to said end portion of said first side of said elastic band; and (e) an electromagnet disposed beneath said permanent magnet for interaction therewith, said electromagnet, when energized, producing alternating magnetic fields which will attract and repel said permanent magnet.

2. A fluid pumping apparatus as defined in claim 1 comprising:

(a) a second yieldable diaphragm connected to said second side of said elastic band; and (b) a second permanent magnet connected to said end portion of said second side of said elastic band.

3. A fluid pumping apparatus as defined in claim 1 further including a base, said electromagnet and said supporting frame being connected to said base.

4. A fluid pumping apparatus as defined in claim 3 in which said supporting frame comprises first and second sides and in which said apparatus further includes first and second shock absorbers for interconnecting said first and second sides of said supporting frame respectively to said base for vibration isolation of said pump assembly.

5. An electromagnetic reciprocating fluid pump comprising:

(a) a base;

(b) an electromagnet supported on said base for producing alternating magnetic fields;

(c) a supporting frame connected to said base, said supporting frame having upstanding sides;

(d) fluid pumping means for pumping fluid connected to said upstanding sides of said supporting frame, said fluid pumping means including:

(i) a pump body including a pumping chamber having an inlet and an outlet; and (ii) first and second yieldably deformable diaphragms connected to said pump body;

(e) an elastic band comprising a generally U-shaped member having first and second sides interconnected by a curved bight portion, each of said sides terminating in an end portion superimposed over said electromagnet, said first resilient diaphragm being connected to said first side of said elastic band intermediate said end portion and said bight portion and said second diaphragm being connected to said second side of said elastic band intermediate said end portion and said bight portion;

(f) a first permanent magnet connected to said end portion of said first side of said elastic band; and (g) a second permanent magnet connected to said end portion of said second side of said elastic band.

6. An apparatus as defined in claim 5 in which said electromagnet comprises:

(a) a source of alternating current;

(b) a core;

(c) a winding surrounding said core, said winding being interconnected with said source of alternating current to periodically cause said permanent magnets to alternately be attracted toward said core and then be repelled therefrom in the opposite direction, said first permanent magnet laterally moving said first side of said elastic band so as to selectively extend and contract said first resilient diaphragm, while said second magnet laterally moves said second side of said elastic band in the opposite direction so as to extend and contract said second resilient diaphragm.

7. An electromagnetic fluid pump assembly as defined in claim 5 in which said electromagnetic reciprocating fluid pump further comprises shock absorption means connected to said upstanding sides of said support frame for vibration isolation of said fluid pumping means.

8. An electromagnetic fluid pump assembly as defined in claim 7 in which said shock absorption means comprises a first elastomeric shock absorber interconnecting one of said upstanding sides of said supporting frame to said base and a second elastomeric shock absorber interconnecting the other of said upstanding sides of said supporting frame to said base.

9. An electromagnetic reciprocating fluid pump comprising:

(a) an electromagnetic subassembly including:

(i) a housing comprising interconnected top, bottom and side walls; and (ii) electromagnetic means disposed within said housing for producing alternating magnetic fields; and (b) a pump subassembly operably associated with said electromagnet subassembly comprising:

(i) a supporting frame connected to said housing, said supporting frame having upstanding sides;

(ii) fluid pumping means for pumping fluid connected to said upstanding sides of said supporting frame, said fluid pumping means including:

a. a pump body including a pumping chamber having an inlet and an outlet; and b. first and second yieldably deformable diaphragms connected to said pump body;

(iii) an elastic band comprising a generally U-shaped member having first and second sides interconnected by a curved bight portion, each of said sides terminating in an end portion superimposed over said electromagnet, said first resilient diaphragm being connected to said first slide of said elastic band intermediate said end portion and said bight portion and said second diaphragm being connected to said second side of said elastic band intermediate said end portion and said bight portion;

(iv) a first permanent magnet connected to said end portion of said first side of said elastic band; and (v) a second permanent magnet connected to said end portion of said second side of said elastic band.

10. An electromagnetic fluid pump assembly as defined in claim 9 in which said pump subassembly is removably interconnected with said electromagnet subassembly.

11. An apparatus as defined in claim 9 in which said electromagnetic means comprises:

(a) a source of alternating current;

(b) an "E" core;

(c) a winding surrounding said core, said winding being interconnected with said source of alternating current to periodically cause said permanent magnets to alternately be attracted toward said core and then be repelled therefrom in the opposite direction, said first permanent magnet laterally moving said first side of said elastic band so as to selectively extend and contract said first resilient diaphragm, while said second magnet laterally moves said second side of said elastic band so as to extend and contract said second resilient diaphragm.

12. An electromagnetic fluid pump assembly as defined in claim 11 in which said core and said winding surrounding said center core and encapsulated within a potting compound.

13. An electromagnetic fluid pump assembly as defined in claim 12 in which said core and said winding surrounding said center core are maintained in a waterproof environment.

14. An electromagnetic fluid pump assembly as defined in claim 12 in which said top, bottom and side walls of said housing are sealably interconnected.

* * * * *